US005802932A

United States Patent [19]

Vankov et al.

[11] Patent Number: 5,802,932

[45] Date of Patent: Sep. 8, 1998

[54] CUTTER FOR A CUTTING DEVICE OF AN ELECTRIC SHAVING APPARATUS OR BEARD TRIMMER

[75] Inventors: Michael Vankov, Schmitten; Karlheinz Johne, Wiesbaden; Dieter Huth; Gunther Seidel, both of Frankfurt; Rudolf Majthan, Eschborn; Lutz Voigtmann, Ober-Mörlen, all of Germany

[73] Assignee: Braun Aktiengesellschaft, Frankfurt, Germany

[21] Appl. No.: 693,042

[22] PCT Filed: Dec. 28, 1994

[86] PCT No.: PCT/EP94/04330

§ 371 Date: Nov. 13, 1996

§ 102(e) Date: Nov. 13, 1996

[87] PCT Pub. No.: WO95/28258

PCT Pub. Date: Oct. 26, 1995

[30] Foreign Application Priority Data

Apr. 18, 1994 [DE] Germany ..... 44 13 352.9

[51] Int. Cl.[6] ..... B21K 11/00; B26B 19/38

[52] U.S. Cl. ..... 76/104.1; 30/43.92

[58] Field of Search ..... 30/43.92, 346.51; 76/104.1, 116, DIG. 8

[56] References Cited

U.S. PATENT DOCUMENTS

| | | | |
|---|---|---|---|
| 1,833,954 | 12/1931 | Schick | 30/43.92 |
| 2,144,525 | 1/1939 | Dalkowitz | 76/104.1 |
| 2,195,164 | 3/1940 | Bott | 76/104.1 |
| 2,223,768 | 12/1940 | Martin | 76/104.1 |
| 2,273,685 | 2/1942 | Berg | 30/43 |
| 2,281,841 | 5/1942 | Holsclaw | 30/43 |
| 3,064,348 | 11/1962 | Wahl | 30/43 |
| 3,162,065 | 12/1964 | Sheehan | 76/104.1 |
| 3,453,909 | 7/1969 | Yager | 76/104.1 |

FOREIGN PATENT DOCUMENTS

| | | |
|---|---|---|
| A-255283 | 6/1967 | Australia . |
| A-1553660 | 5/1991 | Germany . |
| 43 13 371 C2 | 5/1994 | Germany . |
| A-950246 | 2/1964 | United Kingdom . |

OTHER PUBLICATIONS

PCT/EP 94/04330, International Search Report dated Apr. 21, 1995.

Braun Product Catalog Fall 1992—English version.

Braun Product Catalog Fall 1992—German version.

*Primary Examiner*—Hwei-Siu Payer

*Attorney, Agent, or Firm*—Fish & Richardson P.C.

[57] ABSTRACT

A cutter which performs the function of either the outer or the inner cutter in a cutting device comprised of outer and inner cutters of an electric shaving apparatus or an electric beard trimmer. The cutter includes in its cutting area configured as a plane sliding surface a plurality of teeth extending from a comb strip with slots therebetween and with cutting edges formed on the tooth edges. Arranged on the cutter are one or several wall portions angled relative to the cutting area. The cutting area of the cutter includes a blade made of hardened sheet steel, with the teeth of the blade being produced by etching. The wall portions of the cutter are formed by welding one or several formed sheet metal sections to the blade. The weldment is effected such that the resulting rise in temperature of the blade is so low that the hardened sheet metal material is neither adversely affected by deformations nor exposed to significant losses in respect of hardness and wear resistance. This results in a particularly sharp and long-lasting cutter, with the added effect of affording particular ease and economy of manufacture.

32 Claims, 4 Drawing Sheets

CUTTER FOR A CUTTING DEVICE OF AN ELECTRIC SHAVING APPARATUS OR BEARD TRIMMER

BACKGROUND OF THE INVENTION

This invention relates to a cutter which performs the function of either the outer cutter or the inner cutter in a cutting device comprised of outer and inner cutter of an electric shaving apparatus or an electric beard trimmer, which includes in its cutting area configured as a plane sliding surface a plurality of teeth extending from a comb strip with slots therebetween and cutting edges formed on the tooth edges, and on which cutter one or several wall portions angled relative to the cutting area are arranged, with the outer and the inner cutter being caused to perform parallel relative movements against each other during a cutting action, such that hair entering the slots in the outer and inner cutter will be cut off by the cutting edges.

On pages 4 to 9 of applicant's Product Catalog, Fall 1992 issue, a plurality of electrically powered shavers are offered most of which include, apart from the conventional shaving foil cutter, an additional long-hair trimmer. These long-hair trimmers are essentially comprised of two comb-type cutters having their teeth in relative sliding engagement, of which the outer cutter which is to be moved into engagement with the skin to be shaved is the stationary member, while the inner cutter is the driving member that slides along the outer cutter in an oscillating manner. In the area of the teeth, the blades of both the inner and the outer cutter are required to lie flat against each other in order to prevent hair from penetrating between the outer and inner cutter during a cutting action which necessarily produces less satisfactory cutting results. To eliminate these disadvantages, the sliding surfaces of the blades of outer and inner cutter which slide upon each other must be plane and smooth to allow relative sliding movement of the blades in a nearly snug fit. Additional spring forces exerting a defined contact pressure ensure that the oscillating inner cutter is at all times in snug sliding engagement with the outer cutter.

For an improved cutting performance, it is however not only the planeness but also the sharpness and the service life of the cutters that are of great importance. For this purpose, the cutters are stamped out from a piece of sheet steel or are formed by etching. Subsequently, the sheet metal parts are bent and then hardened. Finally, the surface of the effective cutting areas of the teeth is face-ground and/or polished. The grinding operation makes the prior hardened cutting edges sharper; yet, the cutting edge sharpness obtainable with this process is only in the range of between 10 and 15 $\mu$m. While this presents an improvement of the cutting performance over unground or unpolished sliding surfaces of the teeth, good cutting results still fail to be accomplished.

In addition to the customary short-hair cutter heads for a normal shave, there is further known from DE-A-43 13 371 an electric shaving apparatus having a cutting device comprised of outer and inner cutter. This particular cutting device referred to is a central cutter which is intended to cut longer beard hair. In this central cutter, both the outer and the inner cutter are comprised of a sheet metal member bent in a U-shaped configuration and hardened following the stamping and bending process. To obtain the requisite planeness to ensure good cutting results, the irregularities on the sliding surfaces resulting from the bending action are abraded down by grinding.

Further, commercially available shavers of the 255, 355 or 550 type of the Philips company are known, in which three round cutters serving as outer cutters are provided on the shaving head for sliding engagement with round rotary cutters serving as inner cutters. The outer cutters are round, cup-shaped sheet-metal members integrally made of one piece and including bridge members and slots, with the sheet-metal members being equally subjected to a hardening operation following forming. Subsequently, at least the sliding surfaces thereof are ground to obtain both plane and sharp cutting edges. The cylindrical wall portions angled away from the cutting plane serve as means for mounting the cutter so fabricated on the shaving head frame.

From GB-A-950 426 a cutting device comprised of an outer cutter and an inner cutter for an electric dry shaving apparatus is known. The U-shaped outer cutter includes two cutting areas configured as plane sliding surfaces which are separated from each other by a U-shaped depression. The outer cutter is a sheet-metal member which, in unhardened condition, is formed into a U-shaped cutting member by employing a stamping and a bending process, is then spot-welded to a bottom plate using a resistance-welding process, and then hardened. The resistance-welding process necessarily leaves depressions at the respective weld spots, which are attributable to the contact pressure exerted by the welding electrodes on the wall portions of the outer cutter as they are welded with the bottom plate provided therebetween.

In addition, the spot welding process performed prior to hardening the outer cutter to join the wall portions of the outer cutter to the bottom plate has the effect of bulging the wall portions and distorting the overall structure of the U-shaped outer cutter.

From U.S. Pat. No. 3,453,909 it is known to provide slots in the outer cutter and the inner cutter of a cutting device of a dry shaver by means of an etching process for the purpose of obtaining cutting edges.

SUMMARY OF THE INVENTION

It is an object of the present invention to improve the cutting performance of a conventional cutter provided with angled wall portions using simple and low-cost means.

Because according to the present invention the cutter is manufactured by first effecting a separation of the blade from the wall portions angled away from the blade, it is possible to utilize for the blade a prior hardened material with a highly plane surface from which the final contour of the blade is then etched out in an etching operation. Etching produces very sharp cutting edges, and this sharpness can be maintained only if the sliding surfaces are not subsequently ground as has been usual practice; precisely the action of grinding the sliding surfaces would impair their sharpness by reason of the grit of the grinding wheels and the marks thereby occurring on the sliding surfaces. In a subsequent operation, wall portions of a softer material are welded to the etched and hardened blade member, with the heat necessary for the welding operation being however controlled such that the area of the blade is affected neither by hardening and strength losses, nor by deformations. In the method of the present invention, a melting-point-controlled fusion welding process makes it possible to join wall portions of any configuration to the plane, very hard and sharp blade without adversely affecting the strength, hardness and planeness of the blade.

Accordingly, the invention provides a cutter producing an optimum cutting result when used in a cutting device for an electrically powered shaving apparatus or beard trimmer; this is accomplished because, by reason of the high surface finish and planeness, both blades slide upon each other in an absolutely uniform bearing relationship, in particular when one of the two blades is urged against the other blade by a defined spring force. This positively prevents the occurrence of a cutting gap on the sliding surfaces. The cutting edges of the blades formed by the etching process are so sharp as to neatly cut off the hair entering the slots in the two blades.

By contrast, the wall portion(s) that merely contribute(s) to stiffening and/or supporting and/or guiding the blade, or as member(s) for introducing forces into the blade that serve to generate oscillatory motions, for example, may be of reduced strength, and may be stamped, bent or otherwise formed because of their substantially reduced hardness. After manufacture of the wall portions is complete, they are ultimately welded to the high-strength blade member. For purposes of the invention, it can be considered that apart from fusion welding other joining processes employing heat, such as braze welding, may find useful application. The present invention is suitable for use on both elongate and round cutters.

When according to the further aspect of the present invention the wall portion(s) is (are) welded to the comb strip of the blade, the free ends of the teeth are open in outward direction without being obstructed by the wall portions. In this arrangement, hair may freely enter the slots between the teeth from outside without making contact with the wall portions. This type of attaching the wall portions to the blade is particularly suitable for the inner cutter of central cutting devices in which the outer cutter embraces the inner cutter from outside in a U-shaped configuration, as well as for outer cutters in long-hair trimmers in which only one lateral wall portion is provided forming at the same time the extension of the comb section on the outer cutter.

To ensure that a minimum amount of heat flows into the blade during the welding operation, the wall portions are connected with the comb strip of the blade only by means of small individual tabs. With the further aspect of the present invention, a blade results which finds particularly beneficial application to the outer cutter in long-hair trimmers as known, for example, in the "Braun flex control" and "Braun micron" electric shavers as manufactured and sold by the applicant (Braun Product Catalog, Fall 1992 issue, pages 6 and 7).

With the further aspect of the invention, a cutter arrangement results having teeth on either side of the comb strip which cooperate with corresponding toothed strips on the inner cutter. This enables hair to be cut from either side of the cutting device. This arrangement may well be utilized in particular in long-hair trimmers of electric shaving apparatus which are preferably used as central cutters disposed between two short-hair cutting devices, as known, for example, from the shaver disclosed in DE-A-43 13 371.

One embodiment of the present invention provides welding the blade to the wall portion at the location of the teeth. In a further feature of this embodiment, a plurality of teeth are arranged on either side of the comb strip of the blade, with both rows of teeth of the blade being welded to a respective wall portion. Approaches previously referred to lead to different cutters adaptable to particular uses, with the attendant further advantage of a fused joint between the blade and one or several wall portions which is limited to the teeth of the blade and thus of relatively small size.

In a preferred embodiment of the present invention, tabs are formed on the wall portion corresponding in width and thickness to the teeth. The tabs on the wall portions produce openings enabling hair to be more readily fed by the teeth of the blade and the tabs into the cutting area of outer and inner cutter as the blade slides over the surface of the skin, to be ultimately cut off by the cutting edges of outer and inner cutter.

According to a feature of the present invention, the tabs are welded to the free ends of the teeth. A preferred embodiment of the present invention is characterized in that individual teeth are of shorter length than adjacent teeth, and that the tabs are welded to the free ends of the shortened teeth. By this means, the free ends of the unshortened teeth protrude beyond the wall portions welded to the shortened teeth, with the result that a threading comb protruding beyond the wall portion is formed. Accordingly, the teeth of the blade serve a dual function, that is, a cutting and a threading function, in which the free ends of the teeth protruding over the wall portion operate to engage beneath hair resting against the skin, bringing the hair to an erect position and causing it to enter the slots between the teeth for cutting. This substantially improves the cutting result.

A positive, particularly acute cutting angle is obtained by the cutting edges of the teeth having cross-sections of an essentially trapezoidal configuration. Prior to etching, the surfaces (upper and under faces) in the area of the teeth are covered with a laminate, a negative film or adhesive tape of corresponding width and/or lesser width (sliding surface).

Particularly sharp cutting edges result if these enclose a positive angle, that is, if the angle formed by the sliding surface and the side wall of the slots is smaller than 90°. In this arrangement, a cutting angle of 60°, approximately, has proven to produce particularly good hair cutting results. By obtaining the cutting edges with an etching operation, the possibility exists to arrange the edges at an inclination to the sliding plane, such that they enclose with the sliding plane an angle of about 60°. Etching thus affords a particularly simple method of producing surfaces extending at an inclination to the sliding plane, their edges which extend into the sliding surface forming very sharp cutting edges of the cutter by reason of the positive cutting angle without necessitating further operations.

A particularly low amount of heat flows into the blade, causing the current hardness and planeness of the blade to be maintained unchanged. The welding method employed is preferably a fusion welding method in which the two weld joints are heated to a temperature just sufficient to liquefy them to an extent causing coalescence of the barely molten areas of the metal, resulting in a nearly homogeneous and very firm junction upon cooling immediately thereafter. In this connection, spot welding using a laser beam appears a particularly advantageous method, because it eliminates the need for the contact areas between the wall portions and the blade to be pressure tight or water tight. The spot weldments are only required to establish a firm junction with the blade suited for its intended use to ensure that it is at all times securely connected with the wall portions. The wall portion contributes to strengthening the blade in particular in respect of its flexural rigidity, and the blade may be attached to the shaving head with ease.

On the basis of a fine-grained microstructure of the hardened sheet steel, in connection with the etching process for manufacturing the blade, a so far unsurpassed edge sharpness and freedom from burrs is obtained on the teeth of the blade. The fine-grained microstructure of the sheet steel is obtained by the composition of the steel on the one hand, and by the hardening operation on the other hand. The blade is preferably made of material 1.4034 as per German DIN Standard 17224.

Material 1.4310 as per German DIN Standard 17224 is used in order to obtain a particularly intimate weld junction between the wall portion(s) and the blade. Fusibility and flowability of this class of steel are good, and a very intimate and firm joint is obtained with minimum laser spot welds without inclusions (voids, contaminants, etc.) being formed that reduce the strength.

The surface of the blade, except for the sliding surface, is polished electrolytically, thus elaborate mechanical polishing processes using polishing wheels are avoided. Electrolytic polishing being a process known in the art, it will not be described herein in greater detail. In the electropolishing process, surface roughnesses of less than or equal to 1 $\mu$m, preferably 0.5 $\mu$m, are obtainable, and any surface roughnesses produced by the etching process can be largely eliminated.

To prevent the possibility of injury or irritation to a person's skin during shaving by the free ends of the teeth with their very sharp cutting edges, an embodiment of the present invention provides rounding the ends of the teeth outside the cutting area by the action of temperature or by electropolishing. By briefly heating the free ends of the longer teeth to a state of incipient fusion, these form as they liquefy rounded projections approximately in the manner of welding beads by reason of the surface tension occurring in the process. The cutting edges present in this area are thereby eliminated.

A method with which the cutter can be manufactured to optimum properties in a simple manner. The processes of forming the blade contour from a piece of prior hardened sheet steel having a highly plane surface finish by means of etching, and subsequently fusion-welding the blade so contour-etched to wall portions angled away from the blade without subjecting the blade to further operations show in which simple manner a cutter can be manufactured to high precision.

In cooperation with a second cutter, a cutting device results whose cutting performance is vastly superior to hitherto known performances. By attaching the wall portions to the hardened blade by means of a fusion welding process without distortion occurring, a very low amount of heat reaches the blade, so that hardness and structure of the blade are maintained unchanged. Also, the planeness of the blade is maintained, thus precluding the formation of cutting gaps on engagement of the inner cutter with the outer cutter, so that the high sharpness of the cutting edges which is anyway present ensures a neat cut of any kind of hair.

The cutter manufactured according to the method of the present invention enables a cutting device of highest cutting quality to be obtained for the first time, with the attendant advantage that the pressure at which the inner cutter is urged into contact with the outer cutter by a pressure spring may even be reduced. Among other effects, this also reduces the power consumption of the electric shaver or beard trimmer, which presents an added advantage in particular in the use of rechargeable apparatus.

When a hardened sheet metal strip of fine-grained steel is used, particularly sharp cutting edges are produced by the etching process. Selecting a surface roughness Ra of less than 1 $\mu$m for the semi-finished product of the hardened sheet-metal strip eliminates the need for mechanical polishing operations on the sliding surface.

The surface of the blade is electropolished with the exception of the covered sliding surface. The electropolishing process in connection with the covered sliding surface affords a variety of advantages. For one purpose, the side surfaces of the slots manufactured by etching are polished to a surface roughness of less than 2 $\mu$m, and for another purpose the edges formed by the side walls of the slots to the blade surface opposite the sliding surface are slightly rounded. The advantage thereby obtained is twofold, that is, in operation hair enters the slots more readily, and the skin is treated gently. In electropolishing, still another and very important advantage results from covering the sliding surface with adhesive tape or some other covering means, because the sharpness of the cutting edges is increased still further since it involves the removal of a small amount of stock on the lateral edges up to the adhesive tape, without however such stock removal being continued on the sliding surface as disclosed in the invention. In this manner, cutting edges of the highest sharpness are obtained in a simple manner. A surface roughness Ra of less than 5 $\mu$m, preferably about 0.5 $\mu$m, on the sliding surface—that is, on the surface not subjected to electropolishing—of the sheet metal strip as supplied is amply sufficient for the cutting operation.

Fusion welding by a laser beam results in a particularly simple joint between blade and wall portions. Laser welding methods can be applied within a minimum of space without the use of filler metals when it is desired to join nearly identical materials by welding. Because the laser is highly focused, broad heating does not take place.

A laser beam effects welding between the blade and at least one wall portion only at individual localized points, which keeps the manufacturing cost low because fewer weld junctions are involved.

Using a subsequent operation in which the free ends of the teeth are heated to a state of incipient fusion by means of a laser beam, rounding of the sharp cutting edges is effected outside the cutting area, the outer surface of these ends then assuming the shape of about half a welding bead or a complete welding bead, being therefore rounded. Such rounding or deburring of the cutting edges outside the cutting area can be achieved in a particularly simple manner by means of a laser beam. It will be appreciated, however, that rounding may also be effected by electrolytic polishing, as described later.

Edges may be rounded by means of an electropolishing process.

In a cutter for the cutting of hair, whose cutting edges are additionally sharpened following etching by electropolishing, in which in the manufacturing process, that is, prior to electropolishing, the sliding surface was covered with a covering means as, for example, adhesive tape. As a result, only the side walls adjoining the cutting edges are electropolished, leaving the sliding surfaces unpolished. This minimum stock removal on one side contributes to further sharpening the cutting edge. This additional sharpening operation of the invention is applicable to any etched blade for electrically powered shavers or beard trimmers.

The invention will be described in more detail in the following with reference to two embodiments illustrated in the accompanying drawings.

DETAILED DESCRIPTION

Figure 1:
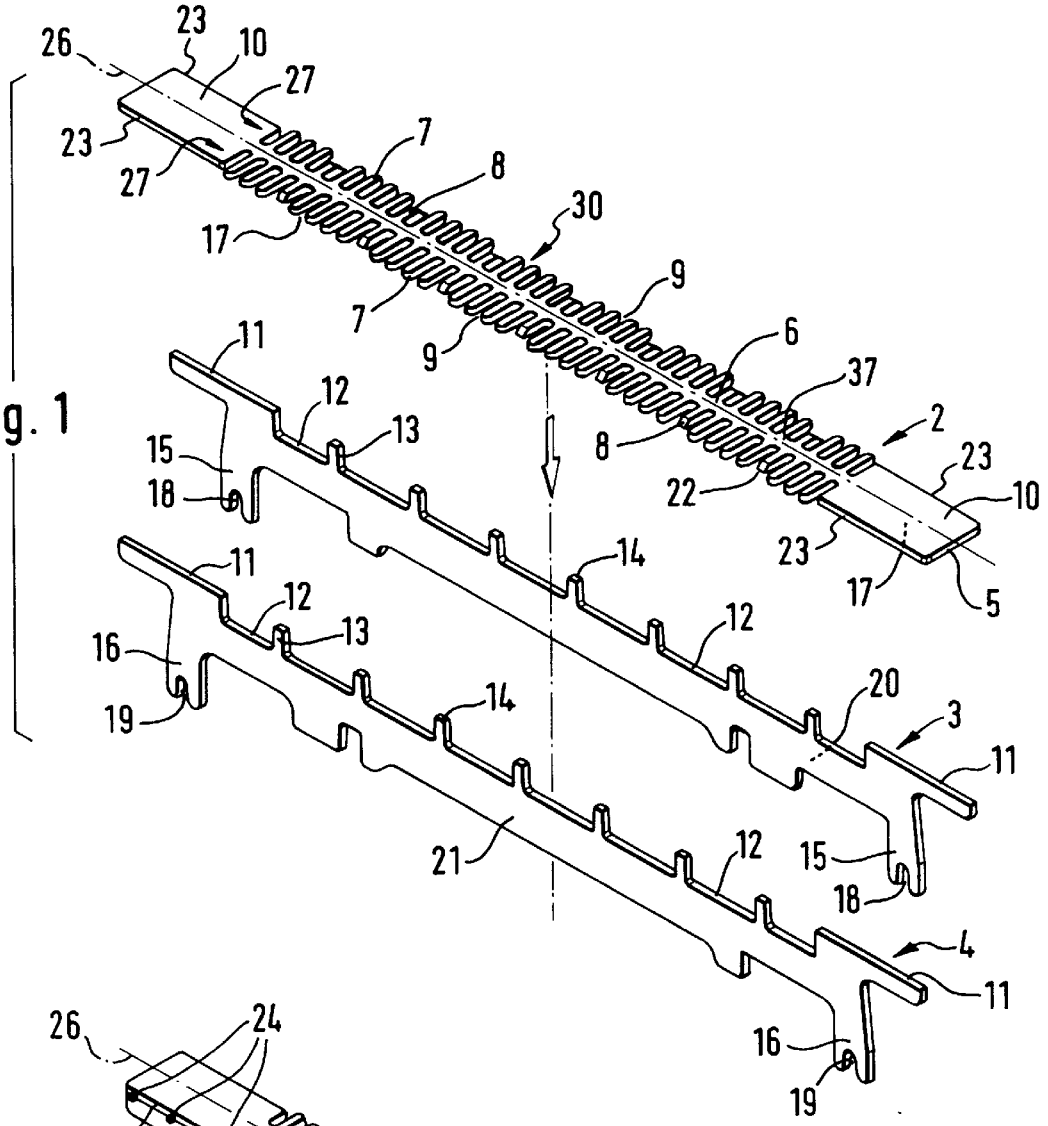
FIG. 1 is an exploded view of an outer cutter adapted to be assembled from three parts.
Figure 2:
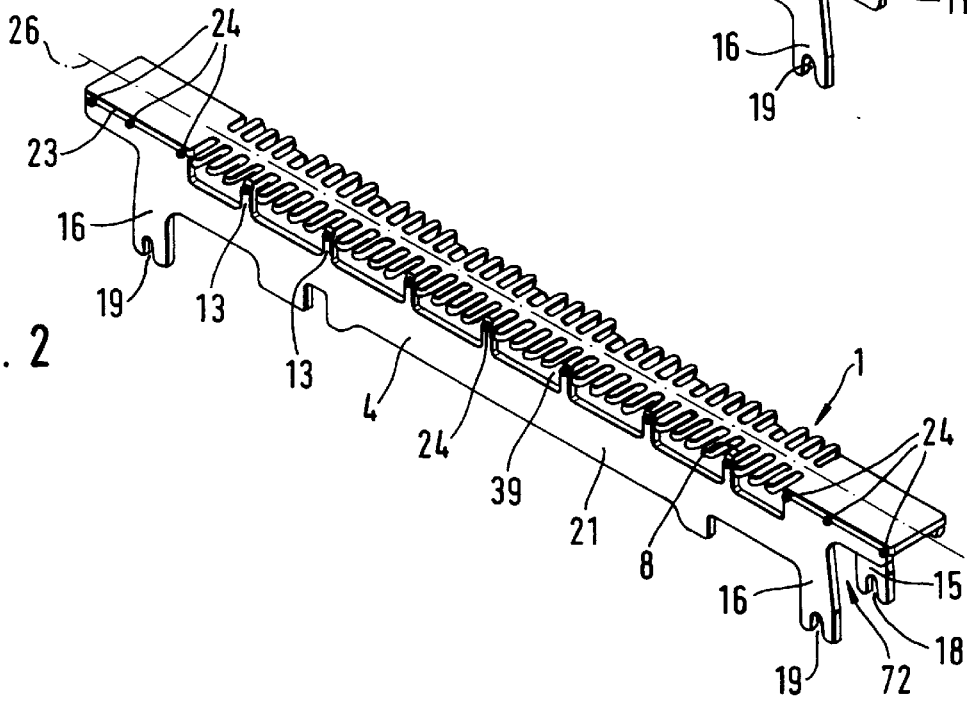
FIG. 2 is a perspective view of the outer cutter of FIG. 1 in assembled condition.

Referring now to FIG. 1, there are shown the details of an outer cutter 1 as they will be assembled to form the finished product of FIG. 2. The outer cutter 1 is essentially comprised of three parts, including the blade 2 and the two wall portions 3, 4. The blade 2 is formed from a sheet steel member 5 of a thickness of 0.4 mm, approximately, and comprises a comb strip 6 having parallel teeth 7 extending to either side in a direction transverse to the longitudinal direction of the sheet steel member 5, whereof every fifth tooth 8 is shortened, while when approaching the respective ends of the sheet steel member 5 one shorter tooth 8 follows every three longer teeth 7. It will be appreciated, however, that the teeth 7, 8 may be arranged also in other sequences.

In FIGS. 1, 2, 4 and 5, slots 9 are provided between the teeth 7, 8 arranged in the rows 27, which slots are all of equal width in this embodiment, but which may also narrow or widen (FIG. 3) in the direction of the comb strip 6, in dependence on the particular configuration of the teeth. At either end, the comb strip 6 has a rectangular sheet metal strip section 10 serving to bear against the bearing surfaces 11 of the wall portions 3, 4 and being configured such as not to project beyond the free ends 22 of the shortened teeth 8.

Figure 4:
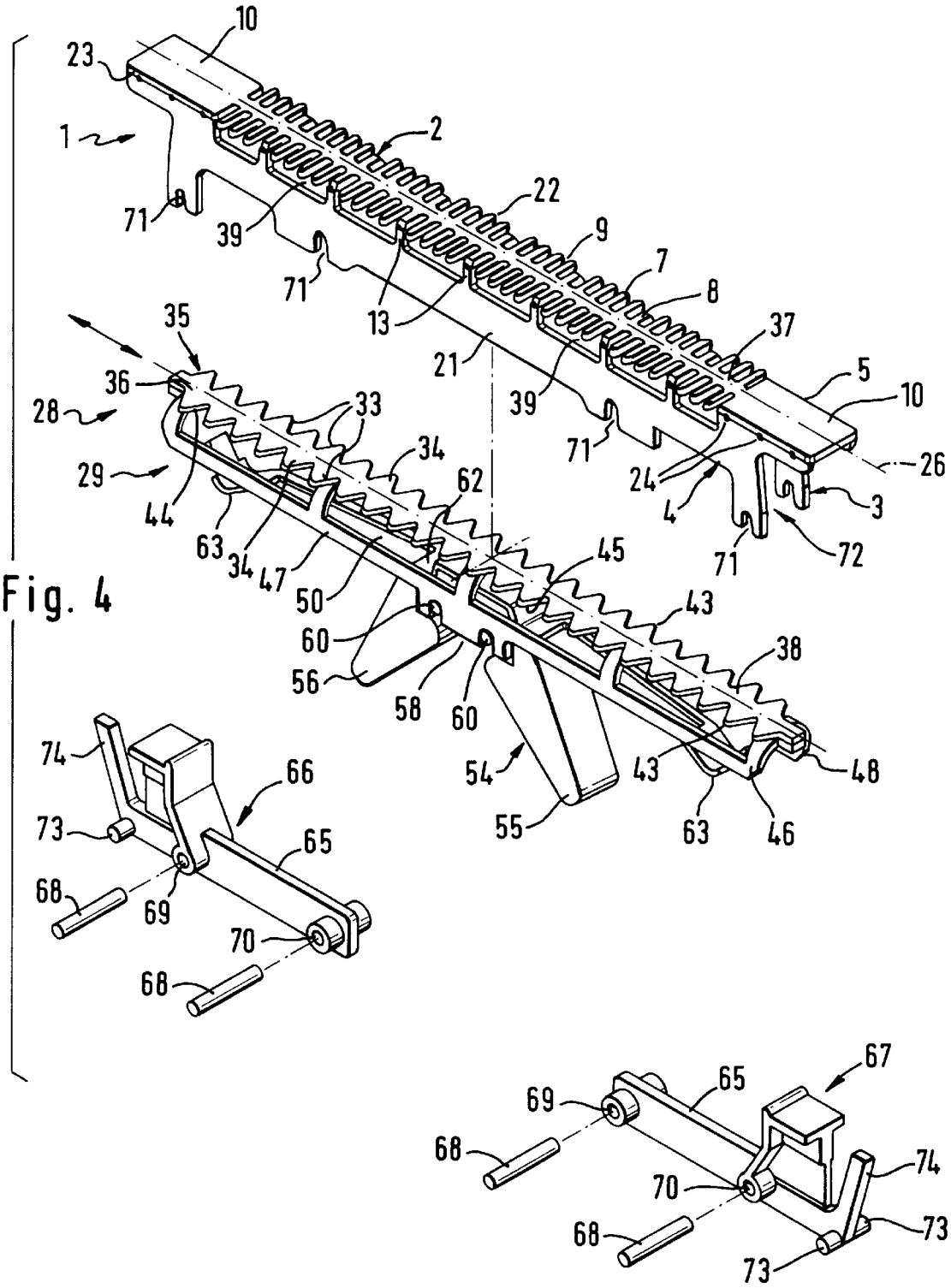
FIG. 4 is an exploded view of a cutting device assembled from outer and inner cutter with base portions.

In FIGS. 1, 2 and 4, the wall portions 3, 4 are formed by unhardened sheet metal strips having tabs 13 on their faces 12 close to the teeth 7, 8, the tabs being arranged on the wall portions 3, 4 at the same relative distance as the shortened teeth 8. The end surfaces 14 of the tabs 13 terminate level with the bearing surfaces 11 to enable the blade 2 to lie flat against the wall portions 3, 4, as shown in FIGS. 2 and 4. As shown in FIG. 4, an elongated slotted opening 39 is thereby formed between every two tabs 13 to enable hair to exit therethrough during shaving. Formed at either end of the wall portions 3, 4 are holding lugs 15, 16 having downwardly open notches 18, 19. The holding lugs 15, 16 lie in the same plane as the wall portions 3, 4.

As FIG. 1 further shows, the sliding surface 17 forming the under face of the teeth 7, 8 and of the sheet metal strip sections 10, that is the blade 2, engages the end surface 14 of the tabs 13 as well as the bearing surfaces 11 such that the outwardly facing sides 20, 21 of the wall portions 3, 4 terminate flush with the free ends 22 of the shortened teeth 8, as well as flush with the edge surfaces 23 of the sheet metal strip sections 10. As becomes apparent from FIGS. 1 and 2, the teeth 7 thus protrude slightly beyond the edge surfaces 23 or the outer wall sides 20, 21. The longer length of the teeth 7 relative to the teeth 8 facilitate the penetration of hair into the spaces or slots 9 between the teeth, in particular in cases where hair tends to lie flat against the skin or is otherwise unruly.

Figure 5:
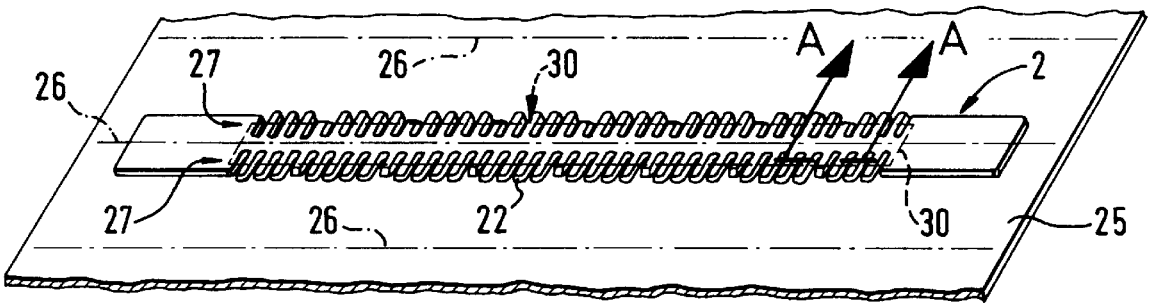
FIG. 5 is a view of the blade of FIG. 1 after being etched from the piece of hardened sheet metal, being accordingly still coated with the laminate.
Figure 6:
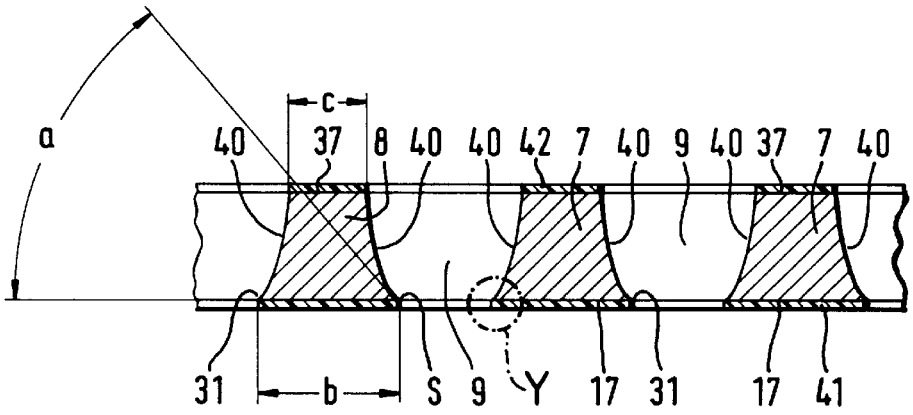
FIG. 6 is a sectional view of individual teeth of the blade, taken along the line A—A of FIG. 5, but on an enlarged scale by comparison with FIGS. 1, 2, 4 and 5.
Figure 7:
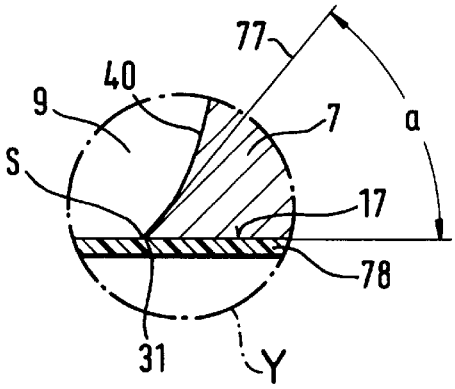
FIG. 7 is a greatly enlarged view of a cutting edge illustrating the detail Y of FIG. 6, but in a condition as it appears subsequent to the polishing operation, its sliding surface being accordingly still covered with adhesive tape or some other covering means.

Whilst the wall portions 3, 4 are stamped from a piece of soft sheet metal, the blade 2 is formed from a hardened strip of sheet metal employing an etching method. FIGS. 5 to 7 illustrate the blade 2 of FIG. 1 as a single component after it is contour-etched in large quantities from a single, prior hardened sheet metal strip 25. In their longitudinal direction, the blades 2 have an axis of symmetry 26 extending centrally relative to the comb strip 6 and the teeth 7, 8.

The further adjacent axes of symmetry 26 shown in FIG. 5 serve to illustrate the arrangement of the individual blades 2 on a sheet metal strip 25 following etching. FIG. 5 further shows which area of the blade 2 essentially serves as cutting area 30. In this arrangement, the cutting area 30 is denoted by a rectangular window drawn in broken lines. The portions of the teeth 7, 8 outside the cutting area 30, that is, the free ends 22 thereof, are rounded to prevent the possibility of injury to the user's skin during shaving.

As becomes clearly apparent from FIG. 6, sharp cutting edges 31 are provided on the outer cutter 1 in the transition area from the sliding surface 17 to the sides 40, the cutting edges forming a positive angle a with the sliding surface 17 which is obtained by applying a tangent 77 to the side 40 at the point of intersection S with the cutting edge 31. As becomes further apparent from FIG. 6, the teeth 7, 8 are of greater width on the sliding surface 17 (dimension b) than on the outer surface 37 opposite the sliding surface 17 (dimension c). In FIG. 6, the cross-sections of the teeth 7, 8 are accordingly of an essentially trapezoidal configuration. The fact that dimension c on the outer surface 37 is smaller than dimension b on the sliding surface 17 is the prerequisite for the formation of a positive cutting angle a. Thus, the greater the difference between dimensions c and b, the smaller and thus the more positive cutting angles a will result.

To obtain such a positive cutting angle a, in FIG. 6 the etching process involves the application of laminates, negative films or foils 41, 42 to the sheet metal strip 25, their contour corresponding to the desired contour of the blade 2 in finished condition. For this reason, the enlarged fragment of FIG. 6 shows the condition of the laminated blade 2 as it results immediately following the etching operation. In a subsequent stage, the laminates or foils or films 41, 42 are removed from the surfaces 17, 37, leaving only the sliding surface 17 covered by adhesive tape 78 for the electropolishing operation. The adhesive tape 78 also covers the slots 9 (FIG. 7).

Therefore, FIG. 7 shows on a still further enlarged scale a corner of a tooth 7 in the area of the cutting edge 31 and the covering means in the form of adhesive tape 78 covering the sliding surface 17 and the slots 9. As becomes clearly apparent from this Figure, the curvature of the side 40 increases progressively in the direction of the cutting edge 31, whereby a particularly acute cutting angle a is formed.

According to FIG. 4, the cutting device 28 is comprised of the outer cutter 1 described in the foregoing and an inner cutter 29, in which the inner cutter 29, when assembled with the outer cutter 1 to form a finished component (not shown), enters the substantially U-shaped receiving chamber 72 formed by the outer cutter 1, such that the sliding surface 38 of the inner cutter 29 rests snugly against the sliding surface 17 of the outer cutter 1 in a sliding relationship thereto.

Figure 3:
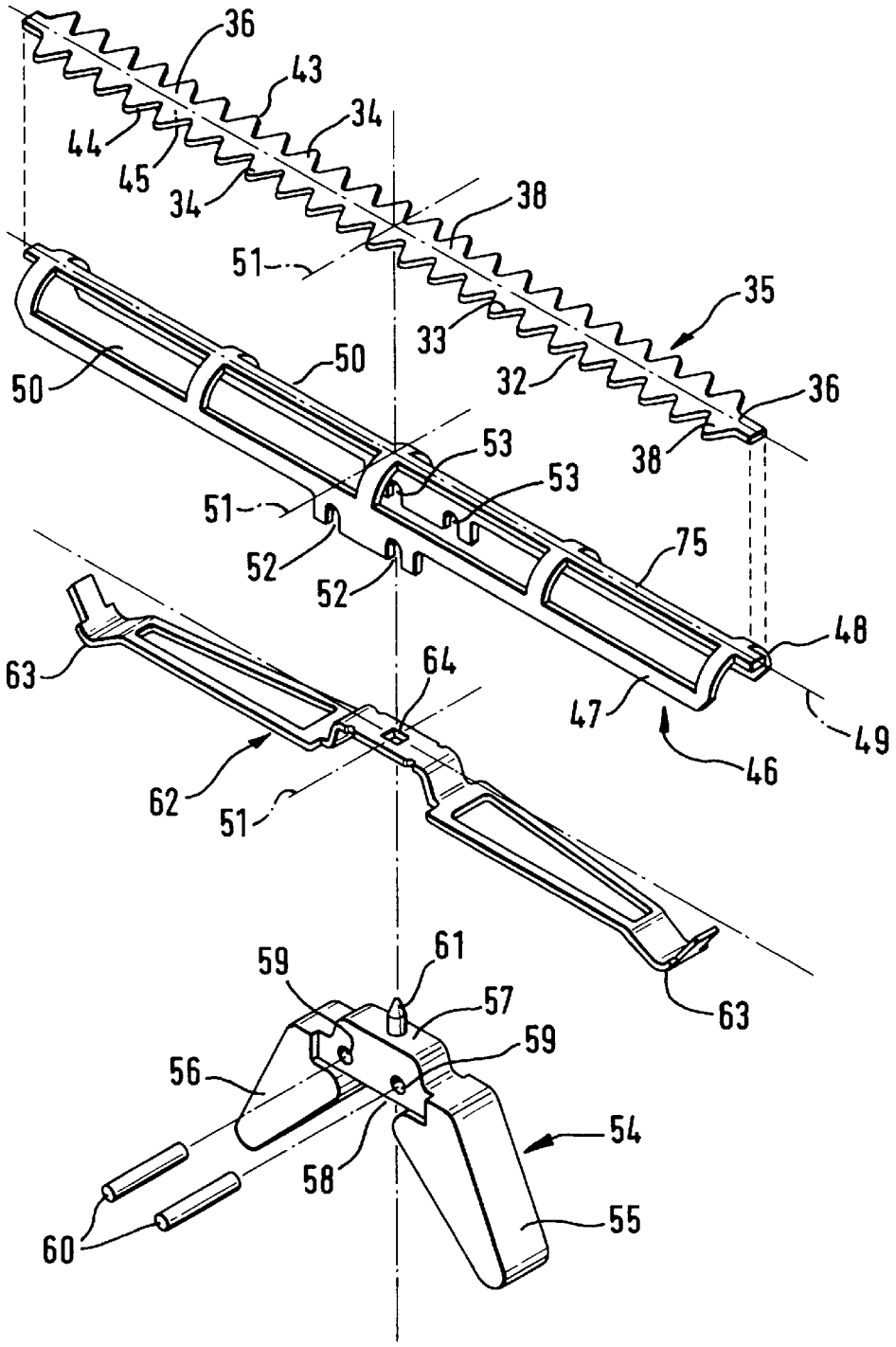
FIG. 3 is an exploded view of an inner cutter.

According to FIGS. 3 and 4, the inner cutter 29 is equally comprised of a blade 35 having teeth 34 extending transversely to the comb strip 36 as well as slots 32, in which, however,—in contrast to the teeth 7, 8 of the outer cutter 1 which extend substantially parallel to each other—the teeth 34 taper towards their free ends 43, causing the slots 32 to widen correspondingly. In addition to effecting the vertical shearing action (two cutting edges extending parallel to each other in opposed directions), this causes during cutting also a pulling cutting motion transversely thereto in the longitudinal direction of the teeth 7, 8, 34, which improves the cutting performance still further.

As appears from FIGS. 3 and 4, the cutting edge 33 forms the end of the upwardly facing sliding surface 38 of the inner cutter 29, which sliding surface is in sliding engagement with the sliding surface 17 of the blade 2 when in operation. To avoid repetitions, it will be understood, of course, that the blade 35 of the inner cutter 29 is manufactured by the same method as shown in FIG. 6, producing likewise positive cutting angles a between the sides 44 and the sliding surface 38.

In FIGS. 3 and 4, on the under face 45 of the sliding surface 38 there is provided a downwardly open wall portion 46 curved in a U-shaped configuration and serving as a supporting plate, the length of this wall portion being slightly shorter than the blade 35 and having on both its longitudinal sides 47, 48 windows 50 of rectangular cross-section which extend along its axis of symmetry 49. On each longitudinal side 47, 48, downwardly open receiving bores 52, 53 in the form of elongate slots are arranged symmetrically to the central transverse axis 51, the slots serving as fastening means for an actuating member 54 manufactured from a plastics material.

In FIG. 3, the actuating member 54 is essentially a bridge structure 57 having on either side of the transverse axis 51 downwardly extending legs 55, 56 which encompass a receiving chamber 58 for engagement by an oscillatory member (not shown) which is driven by an electric drive mechanism of a shaver or beard trimmer.

Provided in the bridge structure 57 are two bores 59 extending vertically and symmetrically to the transverse axis 51 and serving to receive pins 60 press-fitted therein, the pins extending at the same time through the receiving bores 52, 53 to thus hold the wall portion 46 in a manner preventing relative rotation, whilst the wall portion 46 is movable in the receiving bores 52, 53 in the direction of the transverse axis 51 in the assembled condition of the cutting device 28 (not shown).

According to FIG. 3, a centrally disposed trunnion 61 extends upwardly from the bridge structure 57, engaging within a bore 64 provided in a spring means 62 with the cutting device 28 in assembled condition (not shown). This thus locates the spring means 62 centrally on the actuating member 54 and thus relative to the wall portion 46 connected with the blade 35.

As illustrated in FIG. 4, the spring means 62 which is shorter than the wall portion 46 has at either end thereof a downwardly curved bearing surface 63 bearing against a respective supporting edge 65 of a respective bearing block 66, 67. The bearing blocks 66, 67 have each two adjacent bores 69, 70 into which trunnions 68 are inserted which, in assembled condition, engage within respective openings 71 provided in the wall portions 3, 4 of the outer cutter 1 in order to thus fixedly connect the outer cutter 1 with the bearing blocks 66, 67 while at the same time retaining the inner cutter 29 within the receiving chamber 72, which is accomplished in that the spring means 62 bears resiliently against the bearing blocks 66, 67, thus ensuring that the wall portion 46 with the sliding surface 38 of the blade 35 is at all times biased into sliding engagement with the sliding surface 17 of the blade 2.

Following assembly, the cutting device 28 forms a compact subassembly comprised of the parts illustrated in FIG. 4. Serving to secure the complete cutting device 28 in a shaving apparatus are the trunnions 73 provided on the bearing blocks 66, 67 with their outwardly extending spring pawls 74 engaging mating arrangements, not shown, on the shaving head.

As becomes further apparent from FIG. 4, the blade 35 is shown as welded to the wall portion 46. Welding is effected in the area of the comb strip 36 of the blade 35 and the highest portion, that is, the central strip 75, of the wall portion 46 (FIG. 3). In this arrangement, too, laser welding affords particular advantages, the laser beam being applied from below through the central strip 75.

The manufacture of the cutter constructed in accordance with the present invention is as follows:

First, the upper and under faces of the prior hardened sheet metal strip 25 are covered with laminates, negative foils, adhesive tape or other non-conducting insulating strips which are identical in contour with the blades 2 and 35 illustrated in FIGS. 3 and 5. In FIG. 6, the width c of the teeth 7, 8 on the surface 37 opposite the sliding surface 17 is smaller than the width b on the sliding surface 17.

In the blade 35 to be manufactured according to FIG. 3, the sliding surface 38 is on the blade upper face, so that in accordance with FIG. 6 dimension b is on this face while dimension c is on the under face. The films or foils 41, 42 are elongate strips with a plurality of serially arranged blade contours, enabling a plurality of blades 2, 35 to be manufactured in a single etching operation. For the sheet metal strip 25, it is necessary to select hardened steel with a fine-grained structure.

Following etching, the foil or film 41,42 is removed from the sliding surface 17 and the surface 37. Then adhesive tape 78 covering also one side of the slots 9 is affixed to the sliding surface 17 (FIG. 7). The blade 2 is then electropolished, but only on the surface 37 and the sides 40, because the adhesive tape 78 covering the sliding surface 17 prevents metal contact therewith. The electropolishing operation effects smoothing of the surfaces 37, 40 to a surface roughness Ra of less than 2 $\mu$m, preferably 0.5 $\mu$m, approximately, that is, very low amounts of metal are removed, causing the cutting edge 31 to be further sharpened.

Subsequent to this action, the adhesive tape 78 is removed from the sliding surface 17, and the contour-etched blades 2, 35 are separated from the sheet metal strip 25 through connecting elements (not shown). Then the blades 2, 35 are welded to their respective wall portions 3, 4 and 46. In the blade 2 of FIG. 1, the wall portions 3, 4 are moved into the position described in the foregoing and illustrated in FIGS. 2 and 4 by means of fixtures not shown, and are spot-welded to the blade 2 using a laser beam, as indicated by the weld spots 24 in FIG. 2. In this process, for example, all tabs 13 are advantageously welded to the shortened teeth 8, and the bearing surfaces 11 are welded to the sheet metal strip sections 10 from outside.

The same applies essentially to the blade 35 of FIG. 3 in which, however, rather than welding on both sides, only the central strip 75 of the wall portion 46 is welded to the comb strip 36 of the blade 35. In this operation, spot welding is the preferred method in order to apply a particularly low amount of heat to the cutting area, that is, to the cutting edges 33. This is desirable to maintain in particular the wear resistance and hardness of this area to thus keep the cutting edges 33 in a durably sharp condition.

In FIGS. 3 and 4, following laser welding, the spring means 62 and the supporting plate configured as wall portion 46 with the blade 35 secured thereto are seated on the actuating member 54 pre-assembled with the pins 60. The inner cutter assembly 29 thus push-fitted together is then inserted into the receiving chamber 72, with the wall portions 3, 4 also performing a lateral guiding function for the inner cutter 29 through the longitudinal sides 47. The inner cutter 29 is inserted into the receiving chamber 72 until the sliding surface 38 of the blade 35 is in abutting engagement with the sliding surface 17 of the outer cutter 1. Then the bearing blocks 66, 67 are approached from below to the prior assembly of outer and inner cutters 1, 29 until the bearing surfaces 63 rest resiliently against the supporting edges 65. Subsequently, the bearing blocks 66, 67 are displaced in the direction of the outer cutter 1 in opposition to the pressure of the spring until the trunnions 68 engage concentrically within the openings 71 provided in the wall portions 3, 4, with the trunnions 68 however extending beneath the wall portion 46. In this position, the metal trunnions 68 are welded or caulked to the wall portions 3, 4, so that the arrangement of FIG. 4 provides a fixed assembly as a central cutter. The dimensions of the supporting edges 65 relative to the sliding surface 17 are such that the force exerted by the spring means 62 on the inner cutter 29 is sufficiently high, and yet not too high, in order to ensure that the sliding surface 38 rests at all times snugly against the sliding surface 17 to obtain good cutting results.

What is claimed is:

1. A method of manufacturing a cutter for an electric shaving device comprising:

providing a hardened sheet metal planar strip;

contour etching the hardened sheet metal planar strip to form a blade with a plurality of teeth and a comb strip;

forming a wall portion from a sheet metal section; and subsequently welding the blade to the wall portion by a fusion-welding process such that the blade is distortion-free.

2. The method as claimed in claim 1, wherein providing includes selecting a material from which the hardened sheet metal planar strip is formed, said material being steel having a fine-grained microstructure with a hardness of about 600 to about 650 HV.

3. The method as claimed in claim 2, wherein providing further includes selecting a surface roughness Ra for the hardened sheet metal planar strip, said surface roughness Ra being less than 1 $\mu$m.

4. The method as claimed in claim 1, wherein following the etching process electropolishing the surfaces of the blade, with the exception of a sliding surface, in an electrolytic bath, said surfaces so electropolished having a surface roughness Ra of less than or equal to 1 $\mu$m.

5. The method as claimed in claim 4, further comprising covering a face of the sliding surface during the electropolishing operation.

6. The method as claimed in claim 1, wherein the fusion-welding process is effected by means of a laser beam.

7. The method as claimed in any one of the claims 1 to 6, further comprising providing a laser beam for welding the blade and the wall portion at individual localized points during the fusion-welding process.

8. The method as claimed in claim 7, further comprising heating the ends of the teeth outside a cutting area to a state of incipient fusion by laser beams.

9. The method as claimed in claim 7, further comprising rounding the ends of the teeth outside a cutting area by an electropolishing process.

10. The method as claimed in claim 3, wherein selecting a surface roughness Ra involves selecting the surface roughness to be about 0.5 $\mu$m.

11. The method as claimed in claim 4, wherein electropolishing involves electropolishing the surfaces of the blade to a surface roughness Ra of about 0.2 $\mu$m.

12. The method as claimed in claim 5, further comprising covering the sliding surface with a cover, and electropolishing the blade.

13. The method as claimed in claim 12, wherein covering involves selecting a cover made of adhesive tape.

14. A cutter which performs the function of either the outer cutter or the inner cutter in a cutting device comprised of an outer cutter and an inner cutter of an electric shaving apparatus or an electric beard trimmer, the cutter comprising: a plurality of teeth extending from a comb strip with slots therebetween and with cutting edges formed on the edges of the teeth, the teeth being in the cutter's cutting area configured as a plane sliding surface, and a wall portion arranged on the cutter and angled relative to the cutting area, with the outer cutter and the inner cutter being caused to perform parallel relative movements against each other during cutting action, such that hair entering the slots in the outer cutter and the inner cutter will be cut off by the cutting edges, wherein the cutting area of the cutter includes a blade made of hardened sheet steel and the teeth produced by etching the hardened sheet steel, and the etched blade is carried by the wall portion formed from at least one sheet metal section welded to the etched blade by a weldment, such that the resulting rise in temperature of the blade when the weldment is formed is so low that the hardened sheet metal is neither adversely deformed nor exposed to significant losses with respect to hardness and wear resistance.

15. The cutter as claimed in claim 14, wherein the weldment between the blade and the wall portion is effected at the location of the comb strip of the blade.

16. The cutter as claimed in claim 15, wherein the wall portion and the comb strip are joined to each other by welding only through individual tabs provided on the wall portion.

17. The cutter as claimed in claim 15, wherein the teeth are provided on a side of the comb strip.

18. The cutter as claimed in claim 15, wherein the plurality of teeth are arranged on either side of the comb strip of the blade.

19. The cutter as claimed in claim 14, wherein the weldment between the blade and the wall portion is effected at the location of the teeth of the blade.

20. The cutter as claimed in claim 19, wherein the plurality of teeth are arranged on both sides of the comb strip of the blade, and that both rows of the teeth of the blade are welded to said wall portion.

21. The cutter as claimed in claim 20, wherein a plurality of tabs (13) corresponding in width and thickness to the teeth are formed on the wall portion and are welded to the individual teeth.

22. The cutter as claimed in claim 21, wherein the tabs are welded to the free ends of the individual teeth.

23. The cutter as claimed in claim 22, wherein certain individual teeth are of shorter length than an adjacent tooth, and that the tabs are welded to the free ends of the shorter teeth.

24. The cutter as claimed in claim 14, wherein the cross-sections of the teeth are of a substantially trapezoidal configuration, the width of the outer surfaces of the teeth opposite the cutting edges being smaller than the width on the surfaces between the cutting edges, and the cutting edges of the teeth arranged to form a positive cutting angle.

25. The cutter as claimed in claim 24, wherein the positive cutting angle is about 60°.

26. The cutter as claimed in claim 14, wherein the wall portion is secured to the blade by spot welding using a laser beam.

27. The cutter as claimed in claim 14, wherein the hardened sheet steel of the blade is steel with a fine-grained microstructure.

28. The cutter as claimed in claim 27, wherein the at least one sheet metal section serving as the wall portion is made of material 1.4310 as per German DIN Standard 17224.

29. The cutter as claimed in claim 27, wherein the steel is made of material 1.4034 as per German DIN Standard 17224.

30. The cutter as claimed in claim 14, wherein a surface of the blade, except for the plane sliding surface, is polished electrolytically and has a surface roughness of less than or equal to 2 $\mu$m.

31. The cutter as claimed in claim 30, wherein the surface roughness is about 0.2 $\mu$m.

32. The cutter as claimed in claim 14, wherein the ends of the teeth outside the cutting area are rounded by the action of temperature or by electropolishing.

* * * * *